United States Patent [19]

Kirchmeyr

[11] 4,227,715

[45] Oct. 14, 1980

[54] ATTACHMENT FOR RELEASE SKI BINDINGS FOR CROSS-COUNTRY SKIING

[75] Inventor: Gustav Kirchmeyr, Innsbruck, Austria

[73] Assignee: TMC Corporation, Baar, Switzerland

[21] Appl. No.: 957,081

[22] Filed: Nov. 2, 1978

[30] Foreign Application Priority Data

Nov. 11, 1977 [AT] Austria ..... 8100/77

[51] Int. Cl.[3] ..... A63C 9/086

[52] U.S. Cl. ..... 280/618; 280/614

[58] Field of Search ..... 280/614, 617, 618

[56] References Cited

U.S. PATENT DOCUMENTS

| | | | |
|---|---|---|---|
| 3,930,661 | 1/1976 | Marker | 280/617 |
| 4,152,009 | 5/1979 | Schmid | 280/618 |
| 4,166,634 | 9/1979 | Kirchmeyer | 280/614 |

FOREIGN PATENT DOCUMENTS

| | | | |
|---|---|---|---|
| 2329880 | 1/1975 | Fed. Rep. of Germany | 280/614 |
| 2418577 | 10/1975 | Fed. Rep. of Germany | 280/618 |

*Primary Examiner*—John J. Love
*Assistant Examiner*—D. W. Underwood
*Attorney, Agent, or Firm*—Blanchard, Flynn, Thiel, Boutell & Tanis

[57] ABSTRACT

An improvement in an attachment for release ski bindings, enabling the skier to selectively decide the mode of skiing, namely, downhill skiing or cross-country skiing. The attachment includes a sole plate which holds the ski boot onto the ski. The sole plate has a connecting piece which is pivotally secured to the front end thereof and is adapted to cooperate with a base plate for holding the toe binding. The connecting piece is pivotal between a position wherein it is adapted to be operatively connected to the base plate for the toe binding and a position overlying the front end of the sole plate. Structure is provided for maintaining the connecting piece in the overlying position on the sole plate during downhill skiing. The sole plate is a two-part construction, each part being pivotally attached to the other about a pivot axis separate from the pivot axis connecting the front end of the sole plate to the connecting piece.

6 Claims, 5 Drawing Figures

ATTACHMENT FOR RELEASE SKI BINDINGS FOR CROSS-COUNTRY SKIING

FIELD OF THE INVENTION

The invention relates to an attachment for release ski bindings for cross-country skiing comprising a sole plate which holds the ski boot on the ski, on which the ski boot is secured by releasable holding elements and is held lockably by means of a connecting piece between sole plate and one ski binding part, wherein the connecting piece is permanently connected to the sole plate (as is actually known) through an axle which extends transversely with respect to the longitudinal axis of the ski and can be swung upwardly against the force of a spring, and wherein the pivot axle (as is actually also known) is arranged substantially below the toe area, and wherein the sole plate which has the connecting piece can be removed for downhill skiing and can possibly be replaced with a common sole plate, and wherein the sole plate which is provided with the connecting piece can be changed into a common sole plate for downhill skiing by pivoting the connecting piece about the pivot axle and by placing the connecting piece into a recess of the sole plate, according to U.S. Pat. No. 4,166,634.

BACKGROUND OF THE INVENTION

The solution which has been described in U.S. Pat. No. 4,166,634, is sufficient to satisfy the set task, however, it has the disadvantage that by placing the connecting piece into a recess, the sole plate or the ski boot is constantly biassed during downhill skiing by the springiness of the connecting piece. A further disadvantage consists in the stepping-in process having to be carried out against the elastic tongue. A stepping-in against the main spring force of the ski binding is in itself difficult in sole plates of common type.

The present invention has the purpose to improve the solution which is described in U.S. Pat. No. 4,166,634, in such a manner that the connecting piece, through which the sole plate is held on the ski binding part for cross-country skiing, is held together with the sole plate in its position, which is pivoted for downhill skiing, without applying a force onto the ski boot. Furthermore, an easier insertion of the sole plate into the ski binding parts is achieved.

The set purpose is inventively attained by the sole plate being constructed in two parts, which parts are connected to another through an axle which extends transversely with respect to the longitudinal axis of the sole plate, and by providing a slide member which grips over the sole plate from above and which is movable in longitudinal direction of the plate or a lock which can be pivoted with respect to the plate, by means of which at least the tongue of the connecting piece can be locked in its position which is pivoted for downhill skiing in a recess of the plate.

This purpose is made easier according to a further characteristic of the invention by providing the recess in the upper side of the sole plate and by the connecting piece being placed with its entire area, which lies within the width dimension of the sole plate, in the recess, so that it forms substantially one plane with the upper side of the plate. This inventive measure does not only achieve a compact structure for the entire sole plate, but also an even flat rest for the sole of the ski boot on the upper side of the sole plate is assured.

BRIEF DESCRIPTION OF THE DRAWINGS

Further advantages and inventive details of the invention result from the following description, which is discussed with reference to the drawings, in which.

DETAILED DESCRIPTION

Figure 1:
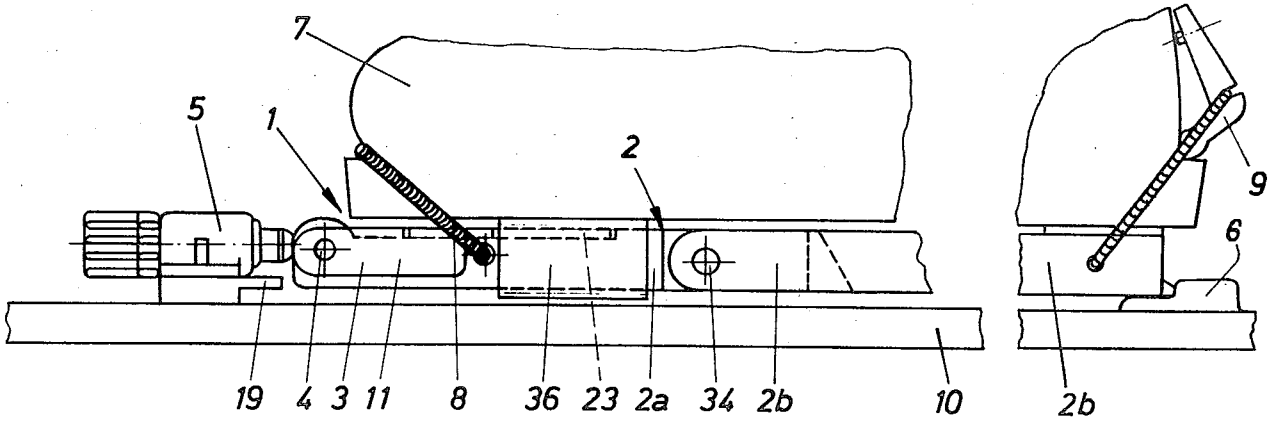
FIG. 1 is a side view of a ski binding with an inventive attachment in the downhill skiing position.
Figure 2:
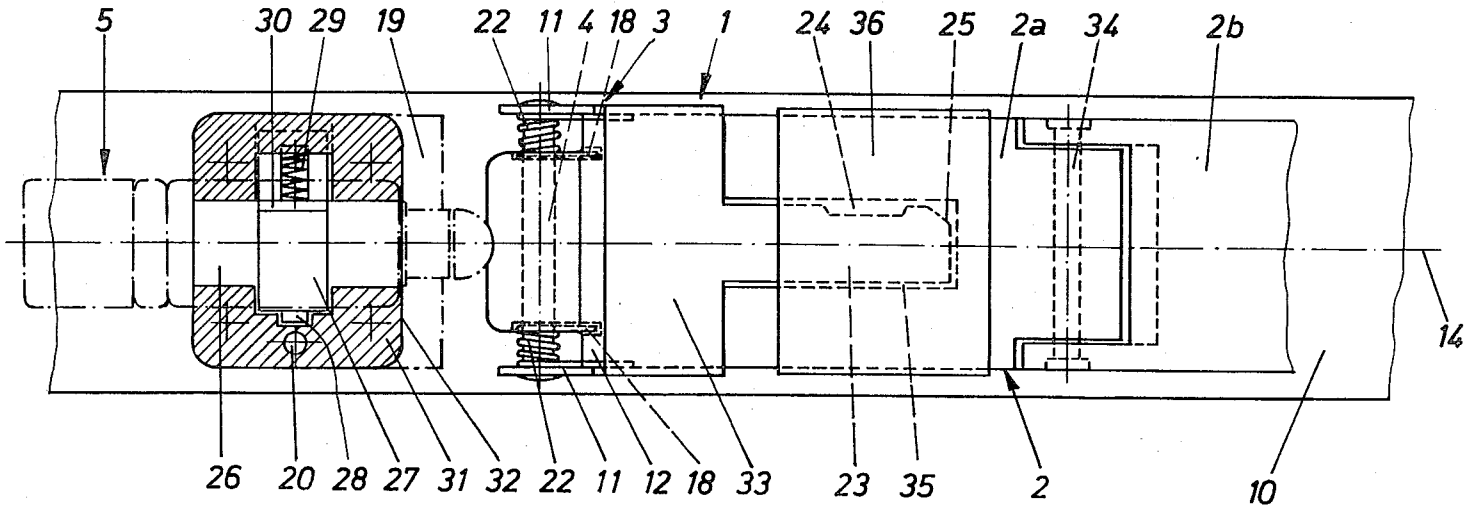
FIG. 2 is a partially sectioned top view of the ski binding in the position for downhill skiing, and only the area of the front ski binding part with the sole plate, leaving out the ski boot, is shown.
Figure 3:
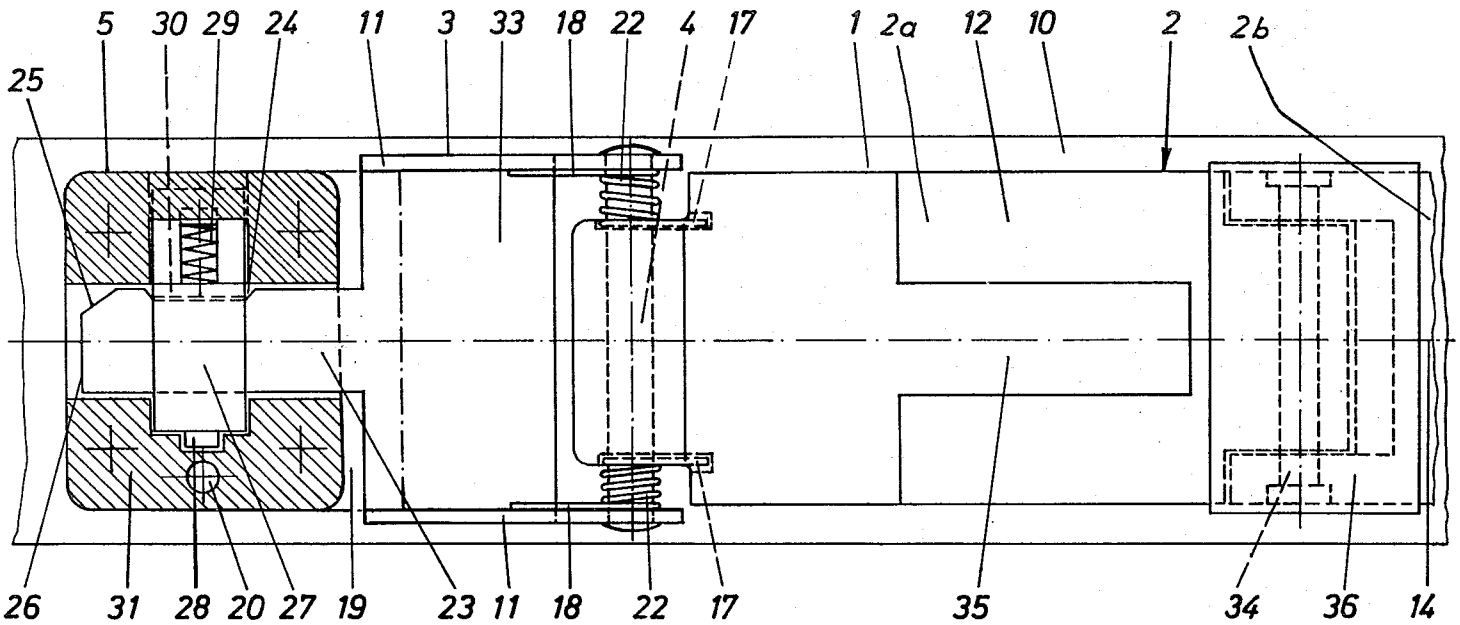
FIG. 3 is a partially sectioned top view similar to FIG. 2, however, in the position for cross-country skiing.
Figure 5:
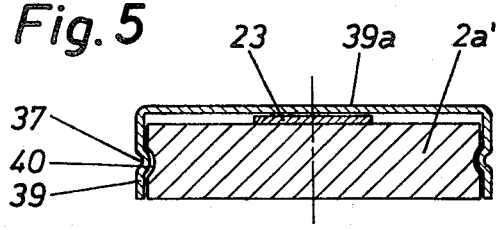
FIG. 5 is a cross-sectional view of a detail taken along the line V—V of FIG. 4.
Figure 4:
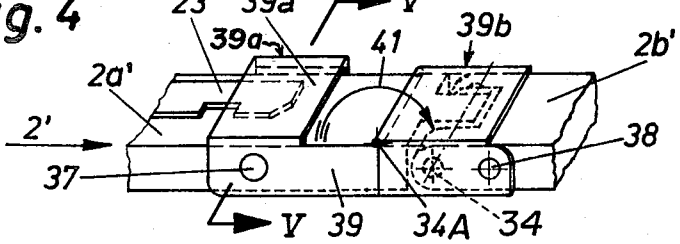
FIG. 4 illustrates a different embodiment of a locking mechanism for the connecting piece.

A locking mechanism of the connecting piece of an inventive attachment is constructed as a slide member in the embodiment according to FIGS. 1 to 3, however, as a swingable lock in the embodiment according to FIGS. 4 and 5.

In the embodiment according to FIGS. 1 and 2, an attachment which is identified as a whole by the reference numeral 1, is constructed consisting of a part 2*a* of a two-part sole plate 2 and of a connecting piece 3. The two parts 2*a* and 2*b* of the sole plate 2 are connected through a hinge axle 34. The front sole plate part 2*a* and the rear sole plate part 2*b* can be reinforced by a slide member 36, which is movable in longitudinal direction of the plate, to form a uniform, rigidly acting sole plate 2. The plate will be, if nothing different is stated, considered as a unit hereinafter and will, as such, be identified by the reference numeral 2. The front sole plate part 2*a* and the connecting piece 3 are connected through an axle 4 with one another and are held through the axle on a ski 10 by a ski binding part 5. A further ski binding part 6 is provided at the other end area of the sole plate 2 such that the sole plate 2 can be inserted in the usual manner between the ski binding parts 5 and 6. In the present exemplary embodiment according to FIG. 1, a ski boot 7 is positioned on the upper side of the sole plate 2 and is releasably held on the sole plate by holding elements 8, 9. The ski binding parts 5, 6 are secured to the ski 10, and the fastening of the ski binding part 6 is done in the usual manner, for example by screws, and the fastening of the ski binding part 5 is done in a manner which will be discussed in more detail hereinbelow. Further parts of the exemplary embodiment according to FIG. 1; as for example the structure and operation of the ski binding parts 5 and 6 and their cooperation with the sole plate 2, are known to those in the field.

From FIG. 1 it will be recognized that the ski boot is held on the upper side of the sole plate 2 for both downhill skiing and also for cross-country skiing by the holding elements 8, 9. For downhill skiing, the sole plate 2, as shown in FIG. 1, is held elastically releasably between the two ski binding parts 5, 6 under spring power (compare the ski binding part 5) on the upper side of the ski, however, for cross-country skiing (shown in FIG. 3), the sole plate 2 is secured to the base plate 31 for the ski binding part 5 by means of the swung-around connecting piece 3.

The sole plate 2 in the cross-country position will thereby lie above the rear ski binding part 6. The thereby created sloped position of the sole plate 2 is advantageous, because accumulations of snow, ice or the like on the upper side of the ski 10 have no influence on the operation.

Details of the embodiment of the connecting piece 3 can better be taken from FIG. 2. The connecting piece 3 is hinged on the axle 4 by means of laterally spaced holding arms 11. The axle 4, which serves as a pivot axis for the sole plate 2, is equipped with a torsion spring 22 of a conventional type. The purpose of this spring will be known to the man skilled in the art. The holding arms 11 enclose a recess 12, which is dimensioned such that the connecting piece 3 can be pivoted about the axle 4 without using specially high bearing points. In the position according to FIGS. 1 and 2, the connecting piece 3 is disengaged from the ski binding part 5.

The connecting piece 3 has a tongue 23, which is equipped with a recess or notch 24. The tongue 23 has adjacent its front end zone a sloped guide surface 25, which facilitates an easier introduction of the tongue 23 into a receiving opening 26 in the ski binding part 5. A slide member 27 is provided on the ski binding part 5 for reception in the notch 24 to lock the tongue 23 to the ski binding part 5, which slide member consists substantially of a Z-shaped profile projecting upwardly with one of its legs, which profile is biassed by a spring 29 toward the notch. The upwardly projecting leg of the slide member 27 functions as an operating lever 28, however, the area of the Z-profile which extends transversely with respect to the longitudinal axis of the ski is bent to form a locking hook 30. The spring 29 urges the slide member 27 which functions as a locking mechanism, always toward the locking position. If the operating lever 28 is pressed against the force of the spring 29 at a right angle with respect to the longitudinal axis of the ski, then the profile part which serves as a locking hook 30 disengages from the recess or notch 24 in the tongue 23 so that the connecting piece 3 can be removed together with the sole plate 2. The same slide member 27 appears in the aforementioned U.S. Pat. No. 4,166,634.

The base plate 31 of the ski binding part 5 is constructed in the area which faces the connecting piece 3 with a continuous support surface 32 for a connecting bar 33 which connects the tongue 23 and the arms 11. In this manner, the connecting piece 3 is supported securely against lateral forces applied to the base plate 31, when the sole plate 2 is held, locked by the tongue 23, in the ski binding part 5.

If the connecting piece 3 is removed from the ski binding part 5 in the above-described manner, then the connecting piece 3 can be pivoted about the axle 4 and received into a recess 35 in the sole plate 2 and can be held in same by means of the slide member 36, after which the sole plate 2 can be inserted as a common plate between the ski binding parts 5, 6 and can be used for downhill skiing. However, one can also proceed in such a manner that the sole plate parts 2*a*, 2*b*, when the tongue 23 is swung back, are pivoted first around the hinge axle 34, thus are placed between the ski binding parts 5, 6, then the two plate parts 2*a*, 2*b* are rendered flat and parallel and only then the slide member 36 is moved for locking the tongue 23 in place. Subsequently, the ski boot 7 is secured by means of the holding elements 8, 9 onto the sole plate 2 which has already been secured to the ski 10. If a sole plate with an attachment for cross-country skiing according to the invention is not used, then it is possible to use the ski binding parts 5, 6 with a common sole plate in unchanged design also only for downhill skiing.

The described construction has the advantage compared with known constructions, that it is not necessary to take along attachments as such and to secure same separately on the ski for the time of the downhill skiing or place same into a knapsack. This is even of an advantage, when we deal with athletes who make several hour-long half-day or all day trips, for whom taking along knapsacks or the like is a routine. Also handling of the inventive construction is superior compared with known solutions due to its simplicity, in particular due to the easy insertion of the divided sole plate. A further advantage consists in that no separate bindings for downhill skiing and for cross-country skiing must be bought for rental-ski stations, and the comfort for both types of use is satisfactorily assured.

The exemplary embodiment according to FIGS. 4 and 5 shows a different type of locking for holding down the tongue 23 in its swung-back position. In place of the slide member 36, a lock 39 is provided which is pivotal about a pivot axle 38, which extends substantially at a right angle with respect to the longitudinal axis of the sole plate 2. The lock 39 is comprised of two parts 39*a* and 39*b* hingedly connected about a hinge axis 34A. The lock 39 further has on both sides of the sole plate 2 detent pins 37 which are received in recesses 40 on both sides of the sole plate 2. It is understandable that according to the invention, the pivot axle 38 is provided in the rear plate part 2*b'* and the recesses 40 in the front plate part 2*a'*. Also it is understandable that the lock 39 must bridge with its bar or crosspiece 39*a'* the tongue 23 in its swung-back position. Furthermore, it is also necessary that the detent pins 37 are placed with a force into the recesses 40, that the force of the spring 22 which biasses the tongue 23 is alone not sufficient to open up the lock 39 about the hinge axis 34A. On the other hand, the locking function is only so strong, that the connecting piece 3, grabbed on the holding arms 11 and pivoted upwardly about the axle 4, opens, together with the spring force 22, the lock 39.

Beyond the advantages, which were mentioned above, this embodiment has the further advantage that during a stepping into the ski binding parts 5, 6, the two plate parts 2*a'*, 2*b'* are pressed down by means of the ski boot, assuming that the connecting piece 3 is swung rearwardly and is moved into the closing position by means of the lock 39. Also an automatic or unintended moving of the slide member 36 according to the first exemplary embodiment is avoided hereby, and on the other hand it is not necessary that the slide member slides with a close tolerance on the sole plate, which measure can cause in particular during iced-up condition of the ski binding, slight difficulty in operation.

Just to be complete, it is remarked that the sole plate 2 can be used in its form which is shown in FIG. 3 as a common plate for the downhill skiing. The connecting piece 3 must, for cross-country skiing, be moved into the position, which has already been described with reference to the embodiment according to FIG. 3, and in this case the lock 39 is now locked in the "empty" condition. Opening of the lock 39 does not create any difficulties in this case, because in this case the two plate parts 2*a'*, 2*b'* can be angled relative to one another in the hand after release of the connecting piece 3 from the ski binding part 5.

As described above, the lock 39 is constructed approximately U-shaped in a top view. The two legs extend thereby laterally with respect to the sole plate 2', on which legs are provided the two detent pins 37. Aside from the bar 39*a* which is provided in this area, it is also possible to provide a further bar 39*b*, which extends substantially from the pivot axle 38 forwardly and approximately bridging over the hinge axis 34. It is further indicated in FIG. 4, that the lock 39 must be pivoted about the pivot axle 38 in direction of an arrow 41 in order to free the tongue 23 for locking according to FIG. 3. It is furthermore remarked that in the embodiment according to FIG. 4, the position of the tongue, in relation to the first exemplary embodiment according to FIGS. 1 to 3, is illustrated rotated 180° about the longitudinal axis of the ski. In this case, the locking, provided in the ski binding part 5, must be redesigned correspondingly symmetrically.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an attachment for use in cross-country skiing and adapted for operative connection to a releasable toe ski binding member having first releasable locking means thereon for normally holding a ski boot for use in downhill skiing, said toe ski binding member being fixedly secured to a ski, said attachment comprising a sole plate and first means for holding said sole plate on said ski, said sole plate including second means for securing said ski boot thereto, said first means including a connecting piece permanently and pivotally connected through a first axle to said sole plate, said first axle being located substantially directly below the toe of said ski boot and extending transversely with respect to the longitudinal axis of said ski, a spring, said spring being adapted to yield to movement of said sole plate upwardly with respect to said connecting piece and about said first axle and second releasable locking means on said connecting piece and on said toe ski binding member separate from said first releasable locking means for permitting said sole plate and the connected connecting piece to be selectively connected to said toe ski binding member, the improvement comprising wherein said sole plate is comprised of first and second sole plate parts connected to each other through a second axle extending parallel to said first axle, wherein said connecting piece has a tongue member thereon forming a portion of said second releasable locking means, another portion being a part of said releasable toe ski binding member, wherein said first sole plate part has a recess therein, said tongue member being pivotal with said connecting piece about said first axle between a first position wherein said tongue member projects forwardly from said sole plate and a second position wherein said tongue member overlays said first sole plate part and is received in said recess, and including releasable holding means for releasably holding said tongue member in said recess.

2. The attachment according to claim 1, wherein said recess is provided in the upper side of said first sole plate part, and wherein said tongue member is received into said recess, so that it forms substantially one plane with the upper side of said sole plate.

3. The attachment according to claim 1, wherein said holding means is pivotal about a third axle extending through said second sole plate part, wherein said holding means has a substantially U-shape including a pair of legs and a crosspiece, wherein inwardly projecting detent pins are provided on the legs of the U, which detent pins are received in recesses in said first sole plate part, wherein at least said tongue member is gripped over by said crosspiece and is held in said recess in said first sole plate part.

4. The attachment according to claim 3, wherein said holding means has a further bar which holds together said pair of legs, said further bar extending from said pivot axle forwardly over said second axle between said first and second sole plate parts.

5. The attachment according to claim 1, wherein the force which holds said detent pins in said recesses is greater than the force of said spring biassing said connecting piece to said first position.

6. The attachment according to claim 1, wherein said holding means is comprised of first and second parts hingedly connected to each other, said first part being coupled to said sole plate by a third axle, said hinged connection between said first and second parts being located above said first axle.

* * * * *